United States Patent [19]

Davitz

[11] Patent Number: 5,037,708

[45] Date of Patent: Aug. 6, 1991

[54] SILVER PALLADIUM ALLOY

[76] Inventor: Daniel Davitz, P.O. Box 310, Morton Grove, Ill. 60025

[21] Appl. No.: 578,402

[22] Filed: Sep. 7, 1990

[51] Int. Cl.[5] ..... C22C 5/06; C22C 5/08

[52] U.S. Cl. ..... 428/673; 420/503

[58] Field of Search ..... 420/503; 428/673

[56] References Cited

U.S. PATENT DOCUMENTS

| | | | |
|---|---|---|---|
| 3,411,900 | 11/1968 | Roeder et al. | 420/503 |
| 4,895,701 | 1/1990 | Davitz | 420/503 |
| 4,948,557 | 8/1990 | Davitz | 420/503 |

FOREIGN PATENT DOCUMENTS

| | | | |
|---|---|---|---|
| 0057149 | 8/1982 | European Pat. Off. | 420/503 |
| 56-15453 | 4/1981 | Japan | 420/503 |
| 60-258438 | 12/1985 | Japan | 420/503 |
| 60-258439 | 12/1985 | Japan | 420/503 |
| 62-235445 | 10/1987 | Japan . | |
| 1546376 | 5/1979 | United Kingdom | 420/503 |

*Primary Examiner*—Richard O. Dean
*Assistant Examiner*—David W. Schumaker
*Attorney, Agent, or Firm*—Robert S. Beiser

[57] ABSTRACT

A silver colored metal alloy having improved tarnish resistance is disclosed, which is intended primarily for solid sterling jewelry and utensils and may also be used in silver plating, and does not easily tarnish and corrode. The alloy consists essentially of 80% to 92.5% silver, 4% to 9% palladium, 0% to 10% copper and 0.5% to 1% indium or zinc.

5 Claims, No Drawings

SILVER PALLADIUM ALLOY

BACKGROUND OF THE INVENTION

1. Field of the Invention

The present invention relates generally to silver alloys, and in particular to a silver alloy having improved tarnish resistance. Sterling silver ordinarily alloy contains 92.5% silver, and 7.5% copper. Preferably this alloy must be moldable and castable with low surface tension to conform to intricate molds. In addition, the alloy should provide a material which does not easily tarnish and corrode, especially when used for jewelry.

2. Prior Art

Sterling silvery jewelry and utensils are valued because of their intrinsic worth and the silver color of the metal. However, a problem has been found in using sterling silver because of its tendency to tarnish and corrode.

Many attempts have been made to improve the tarnish and corrosion resistance of sterling silver and to improve the casting qualities of sterling silver.

SUMMARY OF THE INVENTION

Accordingly, an object of the present invention is to provide a more corrosion resistant and tarnish resistant silver alloy with better working properties then sterling silver.

For example, an alloy called premium has been provided in the past which comprises 74% $A_g$, 25% Pd 1% ZN. Another alloy previously sold is 66% $A_g$, 23% Pd, 10% Cu and 1% ZN. However, these alloys have been found to be more expensive and thus have not found substantial commercial use.

Accordingly, an object of the present invention is a silver alloy having chemical and physical properties suitable for use in jewelry.

An additional object of the present invention is to provide a silver color alloy, that will have better tarnish, an corrosion resistance with excellent working properties and still have a low cost alloy.

Other objects of the present invention and advantages accruing therefrom will be apparent to one skilled in the art in the following detailed description. all percentages referred to ar percent by weight based on the total weight of the material or mixture.

DETAILED DESCRIPTION OF THE PREFERRED EMBODIMENT

In accordance with the present invention, a silver colored metal alloy is disclosed which is exceptionally tarnish resistant and corrosion resistant and comprises the following ingredients: 80% to 92.5% silver, 4% to 9% palladium, 10% to 0% copper and 1% to 0.5% indium or zinc.

To be considered in the sterling family, an alloy must have at least 92.5% silver. Usually the remainder of the alloy sterling silver is copper and sometimes zinc. In the present invention, we have replaced most or all the copper with palladium to enhance tarnish resistance and corrosion resistance. We find that this not only gives us a more color stable alloy then sterling silver, but also due to the addition of indium and palladium, the working and casting properties are much improved and the alloy is not brittle. The ratio of silver preferred due to cost and to be considered like sterling silver is 92.5% silver, 5% palladium, 2% copper and 0.5% indium or zinc.

Palladium in this alloy gives the alloy a much greater tarnish and corrosion resistance.

The use of copper enhances the working properties when in conjunction with the pal adium and silver.

The specific gravity of this alloy is 10.27 gms/cc plus or minus, 0.5. Other physical properties are as follows:

| | |
|---|---|
| Low Hardness | 105 BRINELL |
| High Hardness | 165 BRINELL |
| Elongation | 15 to 26% |

Specifically, the preferred alloy formula in accordance with this invention is:

| | |
|---|---|
| Palladium | 5% |
| Silver | 92.5% |
| Copper | 2% |
| Indium (or zinc) | .5% |

While the specific alloy described is intended primarily for solid sterling jewelry and utensils, it may also be used in silver plating using conventional silver plating techniques. As a result, a highly tarnish resistant silver plate is provided at a nominal increase in cost.

The above described alloys have a casting temperature of approximately 1850 degrees Fahrenheit plus or minus 50 degrees. The melting temperature of the alloys is approximately 1750 degrees Fahrenheit plus or minus 50 degrees.

Conventional chlorine and/or ammonia testing of this alloy exhibits n tarnishing or corrosion after exposure for 10 days. While this invention has been described with reference to a preferred content and formula, it will be understood by those skilled in the art that various changes may be made and equivalents substituted for elements described herein without departing from the scope of the invention. In addition, many modifications may be made to adapt to a particular situation or material to the teachings of the invention without departing from the scope thereof. Therefore it is intended that the invention not be limited to the particular embodiment disclosed as the best mode contemplated for carrying out this invention, but that the invention will include all embodiments falling within the scope of the appended claims.

I claim as my invention:

1. A silver colored highly tarnish and corrosion resistant alloy comprising in weight percent 80% to 92.5% silver, 4% to 9% palladium, 2% to 10% copper, and 0.5% to 1% indium or zinc.

2. The alloy of claim wherein the casting temperature is approximately 1850 degrees Fahrenheit plus or minus 50 degrees.

3. The alloy of claim 1, wherein the melting temperature is approximately 1750 degrees Fahrenheit plus or minus 50 degrees.

4. A jewelry alloy suitable for rings, earrings and bangles, comprising in weight percent approximately 92.5% silver, 5% palladium, 2% copper and 0.5% indium.

5. The alloy of claim 4, applied as silver plate to a suitable substrate.

* * * * *